United States Patent [19]

Kellogg et al.

[11] 4,387,848

[45] Jun. 14, 1983

[54] CENTRIFUGE ASSEMBLY

[75] Inventors: Robert M. Kellogg, Endwell; Alfred P. Mulzet, Endicott, both of N.Y.

[73] Assignee: International Business Machines Corporation, Armonk, N.Y.

[21] Appl. No.: 839,156

[22] Filed: Oct. 3, 1977

[51] Int. Cl.[3] ..... B04B 1/00

[52] U.S. Cl. ..... 494/81; 422/101; 494/43; 494/45; 494/66

[58] Field of Search ..... 233/1 R, 1 A, 1 D, 27, 233/28, 29, 31, 34, 35, 37, 39, 40, 41, 26; 210/DIG. 23

[56] References Cited

U.S. PATENT DOCUMENTS 3,703,984 11/1972 Pruessner ..... 233/28

4,010,894 3/1977 Kellogg et al. ..... 233/27

FOREIGN PATENT DOCUMENTS 873494 7/1961 United Kingdom ..... 233/28

*Primary Examiner*—George H. Krizmanich

*Attorney, Agent, or Firm*—Paul M. Brannen; Elmer W. Galbi

[57] ABSTRACT

An improved centrifuge assembly comprising a channeled rotor assembly and a fluid container disposed in the channel, whereby the centrifugal separation effects in the fluid container are determined by the geometry of the channel in the rotor. This arrangement is particularly useful for two-stage blood platelet separation. The fluid container is preferably formed from semirigid plastic material and is considered a disposable item to be discarded after a single use. The rotary assembly preferably includes a removable filler piece or center piece formed from a single piece of material, such as rigid plastic, as by machining or molding, and having therein an open-topped channel having dimensions appropriate to receive the semirigid container, which is suitably curved and placed in the channel. Fluid connections are provided from each end of the container and an intermediate point to an axially located multichannel rotating seal. The connections lie in a plurality of radial slots in the filler piece. The channel is divided into two distinct portions, the first portion of the channel being circular with a constant radius, and the second portion being spiral and having a plurality of radiuses, each measured from a different center, the spiral increasing radially outward from its juncture with the first stage. The intermediate fluid connection is established near the junction of the first stage and the second stage. The spiral portion of the channel and container may have an outward slope from bottom to top.

13 Claims, 5 Drawing Figures

CENTRIFUGE ASSEMBLY

BACKGROUND OF THE INVENTION

Previous centrifuges for separating the components of blood are known in which the centrifuge bowl is reusable, and is provided with relatively complex channeling or grooves, and fluid connections, making the device expensive and difficult to clean and sterilize for each use.

DESCRIPTION OF THE PRIOR ART

The present invention provides an improved centrifuge bowl and container assembly for use with blood cell separators of the type shown, for example, in U.S. Pat. No. 3,489,145. In this prior arrangement, a solid centrifuge element was used, having appropriate channels cast or machined therein, and did not contemplate reusable bags. Bag structures not requiring channeled support elements are disclosed in U.S. Pat. Nos. 3,748,101 and 4,007,871. However, such arrangements are not as efficient or economically manufactured as the subject invention. None of this art or other known prior art provides a centrifuge assembly comprising a solid reusable rigid center element arranged to provide a conformed channel for a disposable tube of semirigid material, having fluid connections to appropriate ends thereof. U.S. Pat. No. 4,010,894 also discloses a centrifuge container which can be used for two-stage platelet separation, but it has been found that the present invention provides a much higher yield.

SUMMARY OF THE INVENTION

It is a general object of this invention to provide an improved rotor assembly for a centrifuge.

Another object of the invention is to provide an improved rotor assembly utilizing a disposable container for centrifuging blood to obtain different fractions therefrom.

A further object of the invention is to provide an improved rotor assembly and associated container for centrifuging blood, which is simple and economical in construction, and the container is disposable after a single use.

Still another object of the invention is to provide an improved blood centrifuge assembly particularly suited for efficient two-stage platelet separation.

The foregoing and other objects, features and advantages of the invention will be apparent from the following more particular description of preferred embodiments of the invention, as illustrated in the accompanying drawings and described in connection therewith in the annexed specification.

Briefly described, the improved assembly provided by this invention comprises a rotor assembly, which comprises, in a first embodiment, a centrifuge bowl and a filler or center piece, which can be removable from the bowl.

An open-topped channel, rectangular in cross section, is machined, molded or otherwise formed in the filler piece. The channel has a first portion which is circular, lying at a constant radius from the true center of the filler piece, which is coaxial with the centrifuge shaft or rotating means. This first portion extends through a first angular distance, of the order of 180 degrees, for example, from the innermost end of the channel. A short transition portion connects the terminal end of the circular portion with the initial end of the second portion of the channel, which initial end is located at a shorter radius from the true center than the radius of the first portion.

The spiral portion comprises a plurality of arcuate segments, of increasing radius, and having centers displaced from the true center. The spiral portion progresses radially outward, and terminates near the angular location of the initial end of the circular portion.

Fitted into the channel described above is a fluid container comprising a tube having a rectangular or substantially rectangular cross section, closed at both ends, and provided with a plurality of fluid connections or inlet and outlet tubes. These tubes, together with a suitable rotating seal, permit the introduction of whole blood into the container and the withdrawal of blood fractions following centrifugal separation. The cross-sectional area of the spiral portion of the container is substantially one-fourth of the cross-sectional area of the circular portion of the container, in order to achieve higher flow velocity in the spiral portion. The fluid container and the tubing connections may be formed of medical grade polyvinyl chloride.

In another embodiment, the entire rotor assembly is made in one piece by molding and/or machining, with a channel as above described formed in the rotor.

BRIEF DESCRIPTION OF THE DRAWINGS

In the drawings.

Similar reference characters refer to similar parts in each of the several views.

DETAILED DESCRIPTION OF PREFERRED EMBODIMENTS

Figure 1:
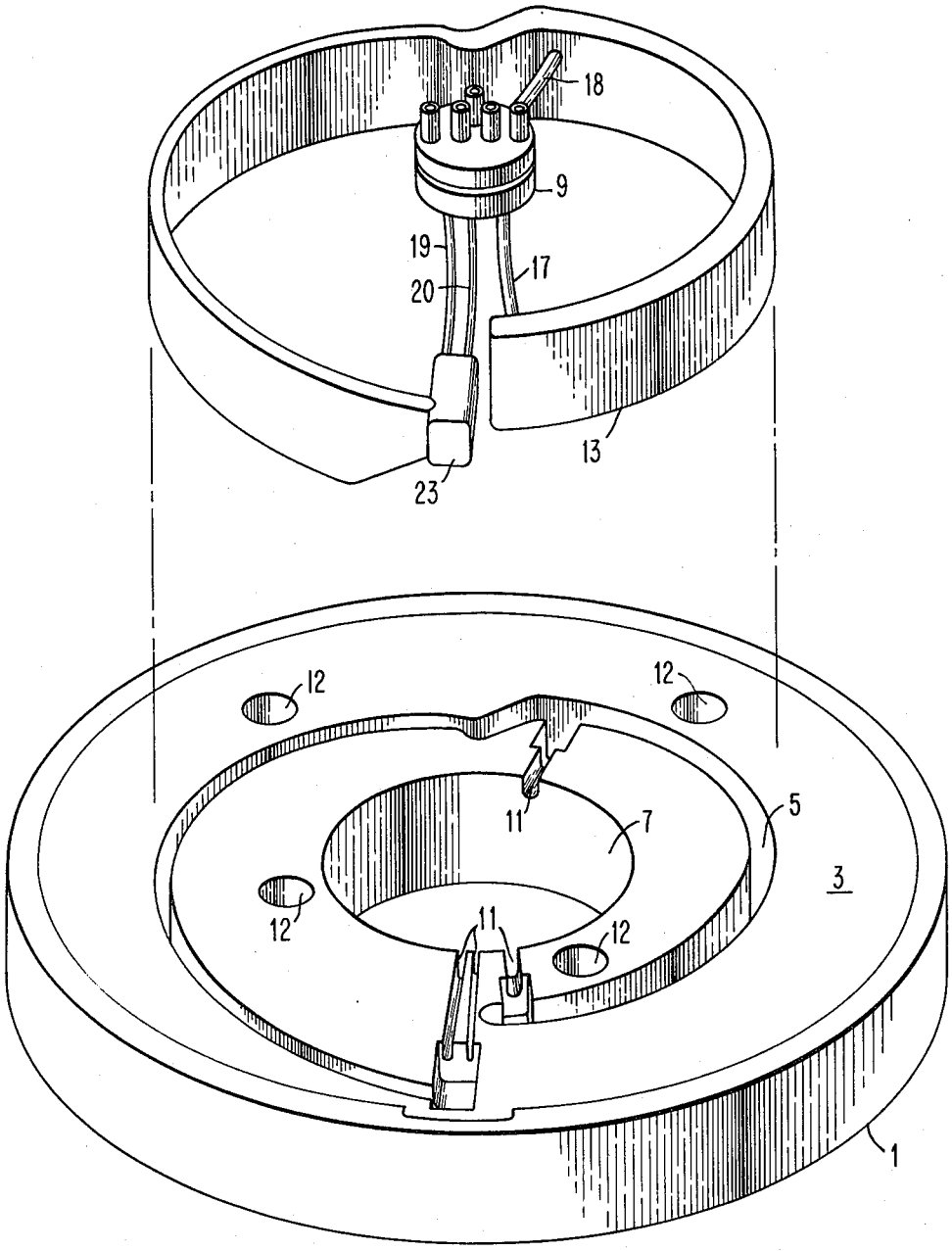
FIG. 1 is a diagrammatic perspective view showing a centrifuge bowl, a filler or center piece, and a fluid container in an exploded relation in accordance with one preferred form of the invention.

Referring to the drawings, there is shown, in FIG. 1, a centrifuge bowl 1, arranged to be spun around an axis of rotation by suitable means, not shown since the specific rotating means is not germane to this invention. The bowl can be formed of any suitable material such as metal or plastic or a combination of materials.

Seated within the bowl 1 is a filler or center piece 3 which can be formed of any suitable material, by molding and/or machining. The filler piece 3 is dimensioned so that when in place in the bowl 1, the filler will be concentric with the bowl. It can be retained in place on a central hub, or on the outer rim or a plurality of distributed bosses or pins. A channel 5, described later in detail, is machined, molded or otherwise formed in the top surface of filler piece 3. The filler piece 3 has a central hole or opening 7 which accommodates the fluid connections to the fluid container, to be subsequently described, and a rotating seal 9. Also the opening may be dimensioned to fit over a central hub in the bowl, to accurately locate and retain the filler piece.

The seal 9 may be of the type shown in U.S. Pat. No. 3,489,145, for example. Filler piece 3 also has a plurality of radial slots 11 in the upper portion of the piece, which receive the fluid connections or tubes to the container. Additional openings 12 are provided to not only provide dynamic balance of piece 3, but also to serve as finger grips for lifting piece 3 into and out of the bowl 1.

The fluid container comprises a length of semirigid plastic tubing 13, preferably of medical grade polyvinyl chloride, and having a substantially rectangular cross section. Two different cross-sectional areas are provided, as later described. The tubing is formed in a spiral-like configuration as shown, with each end sealed, and the container is generally shaped to fit the channel 5. Fluid connections to the container are provided by a plurality of tubing connections 17, 18, 19 and 20, one of which (17) serves as an input connection. Connection 18 is for extraction of the red cells, connection 19 serves as an output connection for plasma, and connection 20 serves as a platelet concentrate outlet. When the container 13 is placed in channel 5, the tubes 17, 18 and 19 are placed in the appropriate slots 11 in filler piece 3.

Figure 2:
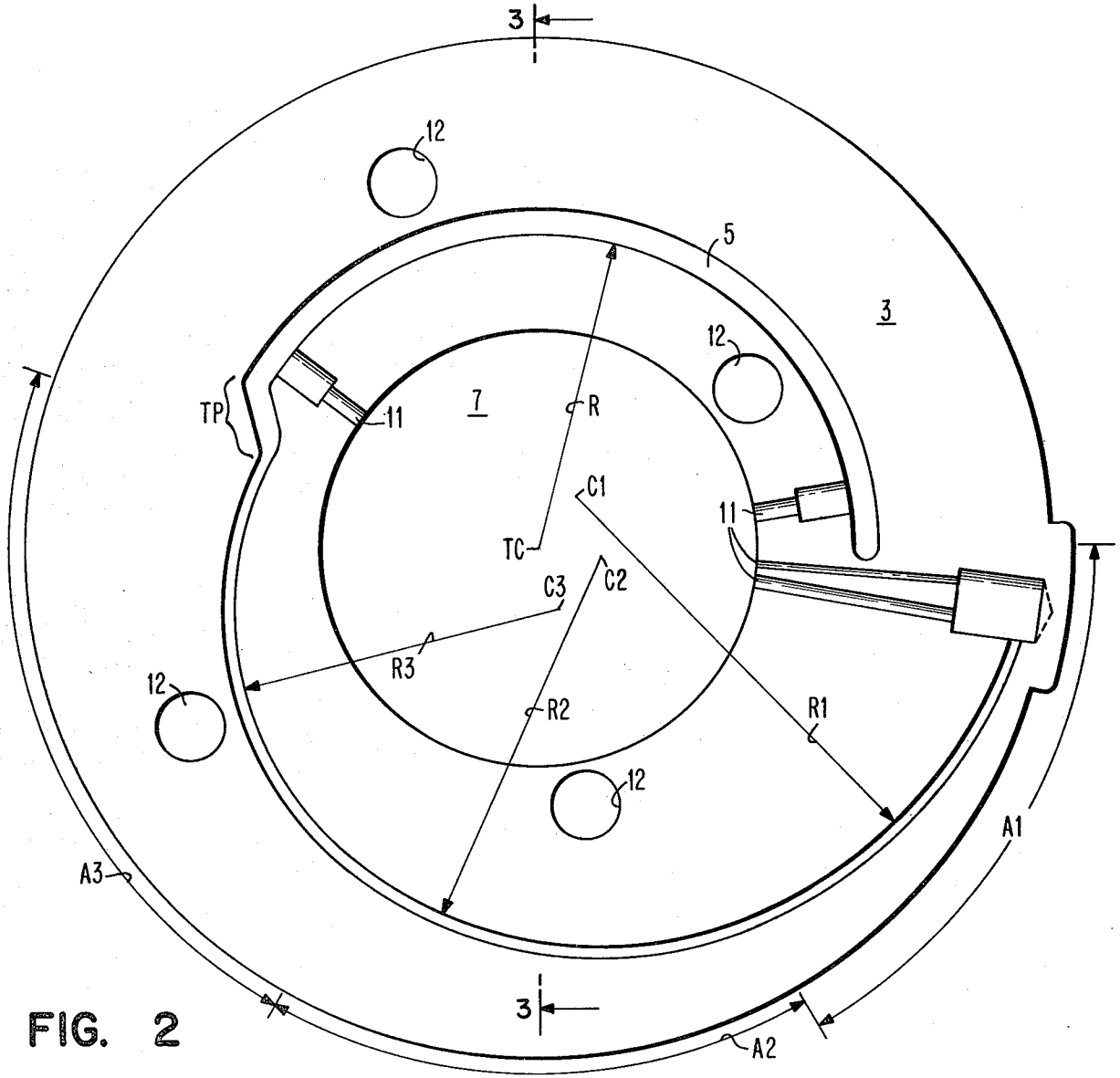
FIG. 2 is a diagrammatic plan view of the filler piece shown in FIG. 1.

FIG. 2 is a plan view of the filler piece shown in FIG. 1, and further shows the relationship between the various elements, particularly the geometric relationships for the various portions of the channel, and hence for the container.

It should first be noted that the channel, and hence the container, have two basic geometric patterns. The innermost or first portion, extending for substantially 180 degrees, is circular having a constant radius R extending from the true center TC of the filler piece. The outermost or second portion comprises three arcuate segments, each having a different radius R1, R2 and R3, of different decreasing magnitudes respectively, and extending from centers C1, C2 and C3, which are located at variously displaced distances from the true center TC. These segments extend through arcs A1, A2 and A3 respectively, and total to substantially 180 degrees. These segments taken together form a spiral portion for platelet concentrate collection as subsequently described. A short transition portion TP couples the first and second portions together. As shown, the transition section leads radially inward from the outlet end of the first portion to the inlet end of the second portion. The inlet connection 17 for the whole blood is connected at the inlet end of the first portion of the container. At the outlet end of the first portion, the fluid connection 18 is provided for removing the red blood cells which are centrifuged against the outer wall of the first portion. The end of connection 18 which penetrates the container extends outwardly almost to the outer wall of the container, so that the packed red cells can be removed without disturbing the interface and the remaining blood fractions and plasma.

Using conventional stroboscopic techniques, the operator of the centrifuge can observe the interface at the transition portion TP, and adjust the flow rates so that the interface approaches very closely the inner wall of the container at the exit bend from the first portion. Such platelets as have already been separated will then move at high velocity through the transition portion and into the smaller spiral portion of the container. It has been found that high flow velocity of the concentrate is very necessary if the platelets are not to aggregate into clumps, which would then require a resuspension operation. For this reason, the inner width of the container for the second portion is reduced to substantially one quarter the inner width of the first or circular portion, for example, one sixteenth inch and one quarter inch respectively. Reduction in the cross section results in higher flow velocity in the narrower portion.

Also, to force the platelets toward the top of the channel, where the collection process can be more easily seen by the operator, the spiral portion of the slot and hence the container is given an outward slope of about 8 degrees for the arcuate segments A1 and A2. In segment A3, the slope is reduced gradually so that at the transition portion, the slot and container are vertical. This slope may be observed in the sectional view of the filler piece, FIG. 3.

At the terminal or outlet end of the spiral portion of the container, there is provided a collecting well or chamber 23. This is a closed cup having a reduced portion of the container entering at one side thereof, slightly above the outward wall or bottom of the cup. A small bore tube extends from the inward or top end of the well down to but not touching the bottom. This tube 20 is the platelet concentrate outlet connection. As noted previously, it is necessary to keep the cross-sectional area relatively small in order to achieve high velocity rates. Thus the platelet concentrate connection 20 is on the order of one thirty-second of an inch I. D. as compared with three-sixteenths inch I. D. for the other connections. A plasma outlet connection 19 is provided at the top of the collecting well or chamber 23.

Figure 3:
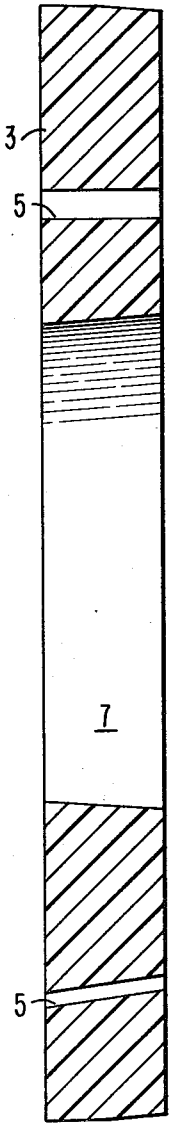
FIG. 3 is a sectional elevational view of the filler piece of FIG. 2 taken at the section 3—3.

FIG. 3 is a cross-sectional elevation view taken along the section line 3—3 in FIG. 2, and shows the slope of the spiral portion of the slot and container, as well as the vertical alignment of the circular portion.

Figure 4:
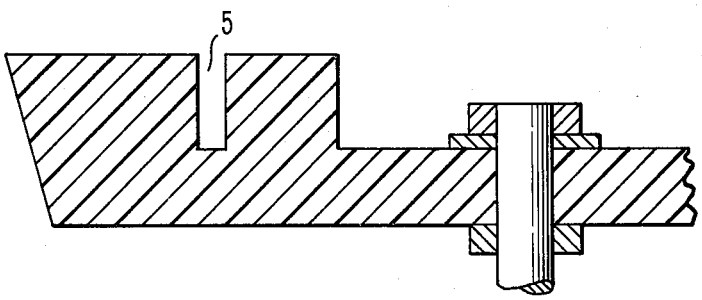
FIG. 4 is a diagrammatic partial cross section elevation view of a centrifuge assembly using a one-piece rotor, in accordance with another preferred embodiment of the invention

It will be readily apparent to those skilled in the art that the embodiment described above provides an assembly in which a plurality of filler pieces could be interchangeably utilized in the same centrifuge bowl, including the one described above. If such interchangeability is undesirable or unnecessary, a one-piece rotor may be used, forming, with the container, another preferred embodiment of the invention. Such a structure will be apparent from the cross-sectional view shown in FIG. 4, showing how the bowl and center piece can be formed from one piece of material, either by molding or machining.

Figure 5:
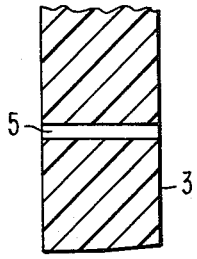
FIG. 5 is a fragmentary cross sectional view of a filler piece having a vertical channel.

In some cases, the outward slope of the spiral portion of the channel and container may not be necessary or desirable, and in such case the channel is vertical throughout the spiral portion as shown in FIG. 5.

From the foregoing, it will be apparent that the present invention provides a novel centrifuge assembly which is advantageous from the standpoint of being economical to fabricate and includes a low cost simple disposable fluid container to be discarded after a single use, thereby removing the expensive duties of cleaning and sterilizing required with reusable centrifuge containers.

While the invention has been particularly shown and described with reference to several preferred embodiments thereof, it will be understood by those skilled in the art that various changes in form and details may be made therein without departing from the spirit and scope of the invention.

We claim:

1. A centrifuge assembly comprising a rotor, means providing a two portion channel in said rotor, a first portion of said channel being circular-like and having a constant radius extending from the true center of said rotor, and a second portion of said channel being spiral-like and having a plurality of segments having different radiuses extending from centers displaced from said true center, a disposable elongated container of semirigid material contained in and conforming to said channel, and fluid connections to each end of said elongated container.

2. A centrifuge assembly for use in a centrifuge having a rotor bowl, comprising, in combination, a filler piece received in said bowl, a channel in said filler piece comprising a circular-like portion and a spiral portion connected seriatim, a disposable elongated container of semirigid material contained in and conforming to said channel, and fluid connections to each end of said elongated container.

3. A centrifuge assembly as claimed in claim 2, in which said fluid connections comprise an inlet connection to one end of said container, and at least two output connections to the other end of said container.

4. A centrifuge assembly as claimed in claim 3, further characterized by an output connection to said container at the outlet end of said circular-like portion.

5. A centrifuge assembly as claimed in claim 2 in which said container is formed from medical grade polyvinyl chloride.

6. A centrifuge assembly as claimed in claim 2 in which said filler piece is provided with a plurality of radial slots to receive said fluid connections.

7. A fluid container for a centrifuge assembly as claimed in claim 2, characterized by said fluid container comprising a length of semirigid tubing having a substantially rectangular cross section.

8. A fluid container for a centrifuge assembly as claimed in claim 7, in which the height and width of the container correspond to the height and width of the channel.

9. A fluid container for a centrifuge assembly as claimed in claim 2, in which the width of the container in said spiral portion is substantially one-fourth of the width of the container in said circular-like portion.

10. A centrifuge assembly as claimed in claim 2 in which the top of the spiral portion of the channel has an outward slope for substantially all of its length.

11. A centrifuge assembly as claimed in claim 2 in which said container is provided with a collecting well at the outlet end thereof, and outlet fluid connections at the outlet end of the container are terminated in said collecting well.

12. A centrifuge assembly comprising a rotor, means providing a two portion channel in said rotor, a first portion of said channel being circular-like and having a constant radius extending from the true center of said rotor, and a second portion of said channel being spiral-like a disposable elongated container of semi-rigid material contained in and conforming to said channel, and fluid connections to each end of said elongated container.

13. A centrifuge assembly comprising a rotor, means providing a two portion channel in said rotor, a first portion of said channel being circular-like and having a constant radius extending from the true center of said rotor, and a second portion of said channel being spiral-like a disposable elongated container contained in said channel, and fluid connections to each end of said elongated container.

* * * * *